United States Patent [19]

Olson

[11] Patent Number: 4,621,732

[45] **Date of Patent: * Nov. 11, 1986**

[54] FASTENING APPARATUS FOR TWIST TIES

[75] Inventor: Robert H. Olson, Pittsford, N.Y.

[73] Assignee: Mobil Oil Corporation, New York, N.Y.

[ * ] Notice: The portion of the term of this patent subsequent to Mar. 31, 1998 has been disclaimed.

[21] Appl. No.: 744,347

[22] Filed: Jun. 13, 1985

Related U.S. Application Data

[63] Continuation-in-part of Ser. No. 512,504, Jul. 11, 1983.

[51] Int. Cl.[4] ..... B65D 69/00

[52] U.S. Cl. ..... 206/346; 24/30.5 R; 206/343; 206/813; 206/820; 428/40

[58] Field of Search ..... 24/16 PB, 16 R, 17 A, 24/17 R, 30.5 R, 30.5 T; 206/338-340, 342-346, 813, 820; 428/40, 43, 187, 189

[56] References Cited

U.S. PATENT DOCUMENTS

| | | | |
|---|---|---|---|
| 2,755,576 | 7/1956 | Golden | 206/813 |
| 3,162,871 | 12/1964 | Powers | 206/343 |
| 4,529,636 | 7/1985 | Olson | 24/30.5 R |
| 4,539,237 | 9/1985 | Clayton | 24/30.5 R |

FOREIGN PATENT DOCUMENTS

| | | | |
|---|---|---|---|
| 0913107 | 12/1962 | United Kingdom | 248/205.3 |

*Primary Examiner*—William Price
*Assistant Examiner*—Jimmy G. Foster
*Attorney, Agent, or Firm*—Alexander J. McKillop; Michael G. Gilman; Charles J. Speciale

[57] ABSTRACT

A twist-tie system, whereby a gang of edge-connected but separable twist ties are fastened to a desired surface. The twist-tie system includes a gang of twist ties, an adhesive layer applied to a portion of one surface of the gang of twist ties, and a removable protective material applied to an exposed surface of the adhesive layer. The protective material can be removed to expose the surface of the adhesive layer to permit fastening of the gang of twist ties to a surface by use of the adhesive layer. At least a portion of the gang of twist ties, spaced from the portion of the one surface of the gang of twist ties, can be formed in a waved profile. Undulations of the waves in this profile extend in a same direction as a longitudinal extent of ties in the gang of twist ties. The removable protective material does not extend beyond a perimeter of the gang of twist ties.

4 Claims, 9 Drawing Figures

FASTENING APPARATUS FOR TWIST TIES

CROSS-REFERENCE TO RELATED APPLICATION

This application is a continuation-in-part of U.S. patent application Ser. No. 512,504, filed July 11, 1983.

BACKGROUND OF THE INVENTION

1. Field of the Invention

The present invention relates to twist ties typically used for closing plastic bags and, more particularly, to an arrangement whereby a plurality of severable, but interconnected, twist ties can be easily fastened by means of an adhesive strip to a holding surface convenient to a user.

2. Discussion of the Prior Art

Twist ties are commonly used for many purposes, one of which is to seal closed the open end of a plastic bag. Typically, a plurality of severable but interconnected twist ties are packaged for sale with plastic bags of various types. Unfortunately, consumers often lose or misplace the twist ties so that when a tie is needed to close a bag, it is difficult to find.

SUMMARY OF THE INVENTION

The present invention has been designed to remedy the problem of lost or misplaced twist ties. Accordingly, an object of the invention is the provision of a fastening arrangement whereby a plurality of interconnected twist ties can be easily fastened by means of an adhesive means, such as an adhesive strip or an adhesive layer secured directly to one surface of the interconnected twist ties, to a convenient holding surface, such as the back side of a cupboard door, to prevent the twist ties from being lost or misplaced, while still permitting individual ties to be severed without disturbing the fastening arrangement.

An additional object of the invention is the provision of a fastening arrangement as described above which is easily and conveniently used by a consumer.

The above objects and others are achieved through the use of an adhesive-backed material which is connected to a conventional gang of severable but interconnected twist ties, the material including a portion thereof which contains an adhesive strip and which is available for fastening to a desired surface. The adhesive-backed material holds the gang of twist ties to a desired surface location, yet permits the severance of individual twist ties without causing a release of the material from the surface to which it is adhered. The portion of the material available for fastening is desirably protected by an adhered covering prior to its being placed in use.

The above objects and others are also achieved through the use of a twist tie system, comprising a plurality of edge-connected, separable twist ties forming a gang of twist ties, adhesive means applied to a portion of one surface of the gang of twist ties, and a removable protective material applied to an exposed surface of the adhesive means, whereby the protective material can be removed to expose the surface of the adhesive means to permit fastening of the gang of twist ties to a surface by means of the adhesive means. The adhesive means can comprise an adhesive layer. At least a portion of the gang of twist ties, spaced from the portion of one surface of the gang of twist ties, can be formed in a waved profile, with undulations of the waves extending in a same direction as a longitudinal extent of the ties in the gang of twist ties.

The above objects, structural features and advantages of the invention will be more clearly understood from the following detailed description of the invention, which is provided in connection with the accompanying drawings.

DETAILED DESCRIPTION OF THE INVENTION

Figure 7:
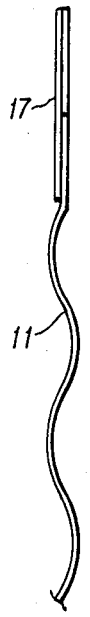
FIG. 7 is a side view of a modification of the FIG. 1 embodiment.
Figure 8:
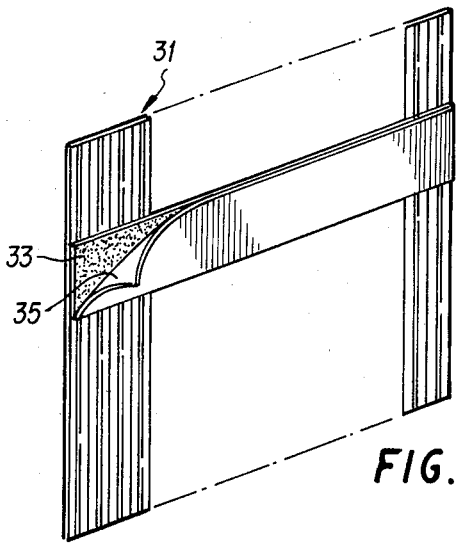
FIG. 8 is a perspective view of a first embodiment of the invention.
Figure 9:
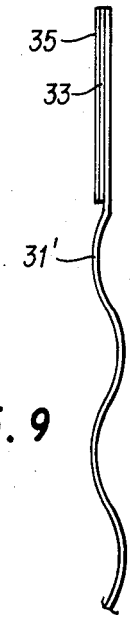
FIG. 9 is a side view of a modification of the FIG. 8 embodiment.

One embodiment of the present invention is illustrated in FIGS. 8 and 9. However, to place the description of this embodiment in perspective, related structures shown in FIGS. 1–7 will first be described.

Figure 1:
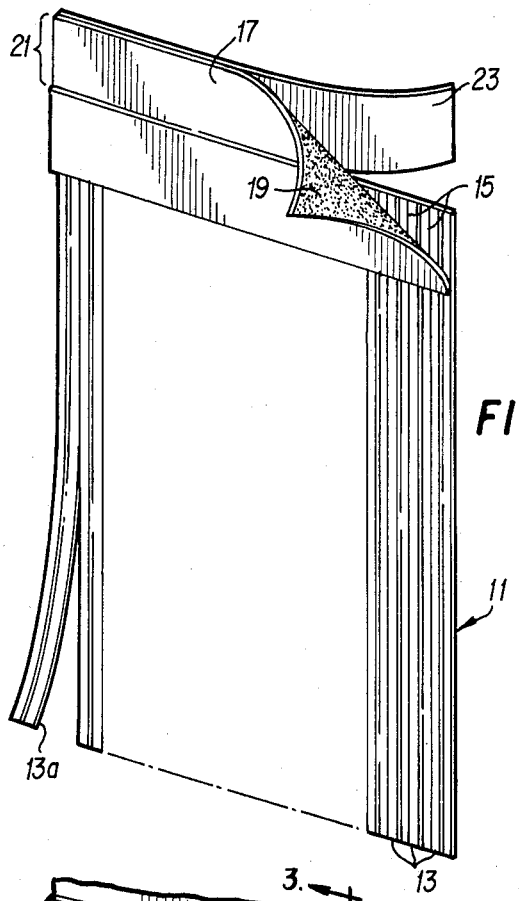
FIG. 1 is a perspective view of a first embodiment related to that of the invention.

A first embodiment related to that of the invention is shown in FIG. 1. A conventional gang 11 of individual twist ties 13 is shown, with the ties arranged vertically. As well known, the individual twist ties 13 are edge connected along perforated lines 15, which permit ready separation of ties 13, one from another. A backing material 17, having an adhesive coated surface 19, is connected along one end of the gang 11 of ties and to each individual tie 13. The upper portion of backing material 17 extends beyond the end of the gang of ties to form a fastening area 21, in the form of an adhesive strip, which can be fastened to any user-convenient surface, such as the front or back side of the door of a kitchen cupboard. A protective covering material 23 is placed over the adhesive of the fastening area 21 during shipping to protect the adhesive coated surface 19. The backing material 17 may be a thin layer of paper or plastics to which the adhesive layer is applied.

Figure 3:
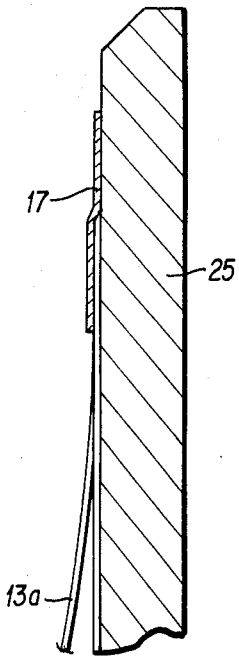
FIG. 3 is a sectional view along the line 3—3 in FIG. 2.
Figure 2:
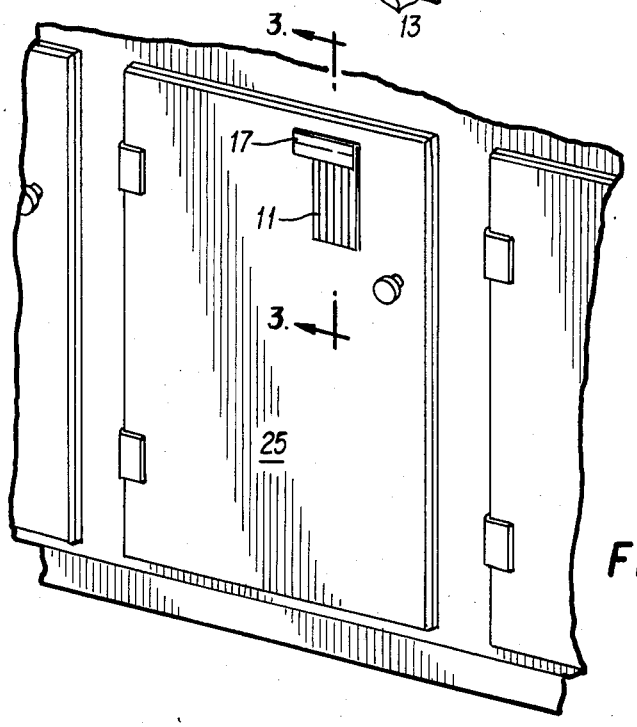
FIG. 2 illustrates one use of the FIG. 1 embodiment.

In use, a consumer removes the protective covering material 23 and presses the adhesive strip of the fastening area 21 to a desired convenient surface, such as a cupboard door 25, as shown in FIGS. 2 and 3. The gang 11 of ties is now firmly secured to a desired surface. When an individual tie **13*a* is needed, the user conveniently removes it from the edge of gang 11 by peeling it off, as shown in FIGS. 1 and 3**.

Figure 4:
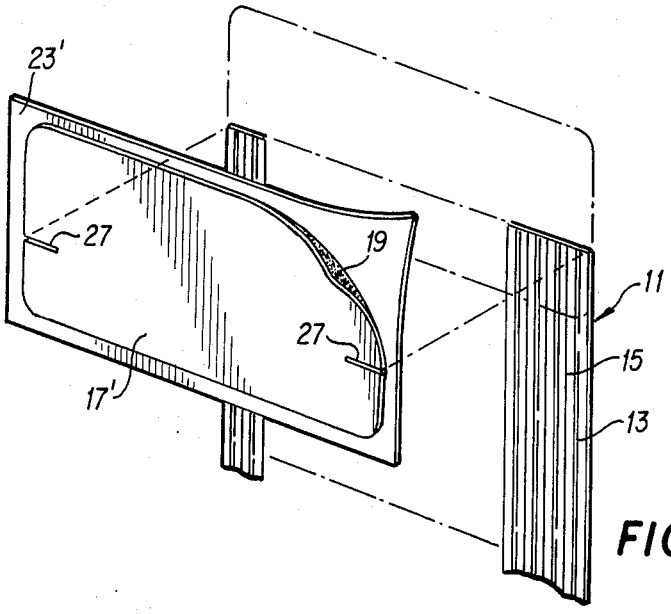
FIG. 4 is a perspective view of a second embodiment related to that of the invention.

FIG. 4 illustrates a second embodiment related to that of the invention, wherein like structures have the same reference numbers as in FIGS. 1–3, and modified structures are indicated by prime symbols. In this embodiment, the backing material 17′ is packaged and shipped with the gang of ties 11, but is not fastened thereto. The backing material 17′ includes an adhesive coated surface 19, which is covered in its entirety by a protective covering material 23'. Visual indicator lines 27 are provided adjacent opposite vertical edges of an exposed side of backing material 17'.

With this embodiment, a consumer first removes the protective covering material 23', thereafter visually aligns the indicator lines 27 with the top edge of the gang of ties 11. He then presses that portion of backing material 17' below indicator areas 27 onto the surface of the gang of ties 11, thereby leaving an exposed upper portion of adhesive surface 19 which is pressed onto a desired surface location, such as the cupboard shown in FIGS. 2 and 3. The removal of individual ties 13 from the gang then occurs exactly as described above with respect to FIGS. 1-3.

Figure 5:
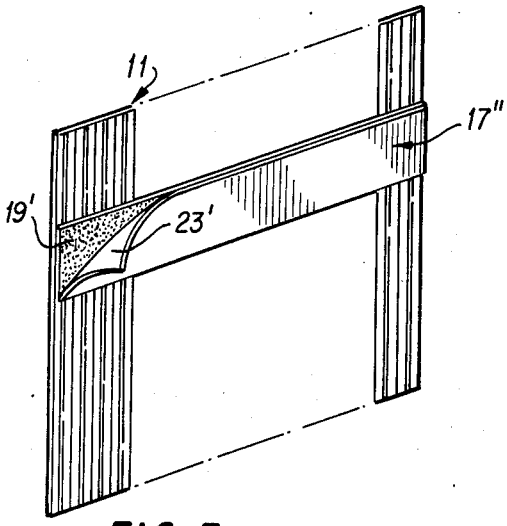
FIG. 5 is a perspective view of a third embodiment related to that of the invention.

FIG. 5 illustrates a third embodiment related to that of the invention. In this embodiment, the backing material 17" is formed as a narrow strip having an adhesive coating on opposite surfaces. One adhesive coated surface is in engagement with a surface oof the gang of ties 11, while the other is protected by protective covering layer 23'. As shown, the backing material strip 17" does not extend beyond the perimeter of the gang of ties 11. In use, a consumer removes protective covering layer 23' and then presses the exposed adhesive strip against a desired fastening surface, in the same manner as described above with respect to previous embodiments.

Figure 6:
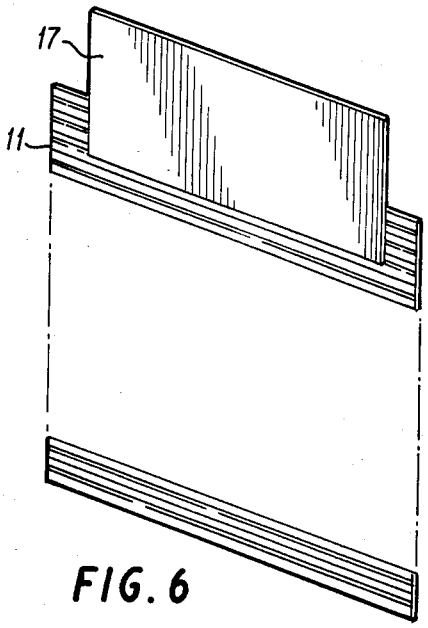
FIG. 6 is a perspective view of a fourth embodiment related to that of the invention.

FIG. 6 illustrates another embodiment related to that of the invention which is similar to that shown in FIG. 1, except the ties 13 of gang of ties 11 are arranged horizontally instead of vertically.

As evident from the above, the invention allows a consumer to securely fasten a gang of twist ties to a convenient surface to prevent its loss or misplacement, while still permitting easily individual severing of the ties when required.

The gang of ties 11 can be conveniently formed into a waved profile, as illustrated in FIG. 7, to provide it with a unique appearance and to make it easier to separate and remove the ties. The undulating waves extend in the same direction as the longitudinal extent of the ties in the gang. If a waved profile is employed, the top of the gang should be straight for 1 to 2 inches to facilitate application of the backing material 17 thereto and the pressing of the assembly onto a desired surface.

FIG. 8 illustrates an embodiment of the invention. In the embodiment, a gang of twist ties 31 has an adhesive means 33 applied to a portion of one surface of the gang of ties. Removable protective covering material 35 is applied to an exposed surface of adhesive means 33. Thus, one surface of adhesive means 33 is in engagement with a surface of the gang of twist ties 31, while the other is protected by protective covering material 35. As shown, material 35 does not extend beyond the perimeter of twist tie gang 31. In use, similarly to the abovedescribed related embodiments, a consumer removes protective covering material layer 35 and then presses the exposed adhesive means 33 against a desired fastening surface. Adhesive means 31 can comprise a layer of adhesive.

FIG. 9 shows a gang of ties 31' formed into a waved profile, similarly to the related embodiment of FIG. 7, with adhesive means 33 applied to a portion of one surface of gang 31' and removable protective covering material 35 applied to an exposed surface of adhesive means 33. As in the FIG. 7 embodiment, the undulating waves extend in the same direction as the longitudinal extent of the ties in the gang. In this waved profile embodiment, the top of the gang should be straight for 1 to 2 inches to facilitate application of the backing material 17 thereto, and pressing of the assembly onto a desired surface.

While the above illustrative embodiments of the invention have been described and illustrated with reference to FIGS. 8 and 9, it should be apparent that many modifications can be made thereto within the spirit and scope of the invention. Accordingly, the invention is not limited by the foregoing description, but is only limited by the scope of the claims appended hereto.

I claim:

1. A twist-ties system, comprising:

a plurality of edge-connected, separable twist ties forming a gang of twist ties;

adhesive means applied to a portion of one surface of said gang of twist ties; and a removable protective material applied to an exposed surface of said adhesive means, whereby said protective material can be removed to expose said surface of said adhesive means to permit fastening of said gang of twist ties to a surface by means of said adhesive means.

2. The system of claim 1, wherein said adhesive means comprises an adhesive layer.

3. The system of claim 2, wherein at least a portion of said gang of twist ties, spaced from said portion of said one surface of said gang of twist ties, is formed in a waved profile, undulations of said waves extending in a same direction as a longitudinal extent of ties in said gang of twist ties.

4. The system of claim 3, wherein said removable protective material does not extend beyond a permeter of said gang of twist ties.

* * * * *